US009630243B2

(12) United States Patent
Eichholz et al.

(10) Patent No.: US 9,630,243 B2
(45) Date of Patent: Apr. 25, 2017

(54) CONTINUOUSLY OPERATING STRIP CASTING AND ROLLING SYSTEM

(71) Applicant: SMS SIEMAG AG, Düsseldorf (DE)

(72) Inventors: Hellfried Eichholz, Ilsede (DE); Karl-Heinz Spitzer, Clausthal (DE); Sven Klawiter, Sarstedt (DE); Rune Schmidt-Jürgensen, Hannover (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 14/412,604

(22) PCT Filed: Jul. 3, 2013

(86) PCT No.: PCT/DE2013/000383
§ 371 (c)(1),
(2) Date: Jan. 2, 2015

(87) PCT Pub. No.: WO2014/005575
PCT Pub. Date: Jan. 9, 2014

(65) Prior Publication Data

US 2015/0144288 A1 May 28, 2015

(30) Foreign Application Priority Data

Jul. 3, 2012 (DE) ..... 10 2012 013 425

(51) Int. Cl.
*B22D 11/12* (2006.01)
*B22D 11/14* (2006.01)
(Continued)

(52) U.S. Cl.
CPC ..... *B22D 11/1206* (2013.01); *B21B 1/463* (2013.01); *B22D 11/041* (2013.01); *B22D 11/0631* (2013.01); *B22D 11/143* (2013.01)

(58) Field of Classification Search
CPC ..... B22D 11/0631; B22D 11/1206; B22D 11/143; B21B 1/463
(Continued)

(56) References Cited

U.S. PATENT DOCUMENTS 4,033,492 A 7/1977 Imai
4,271,894 A * 6/1981 Kimura et al. ..... B22D 11/066 164/432
(Continued)

FOREIGN PATENT DOCUMENTS

DE 2233932 1/1974
DE 2618901 11/1976
(Continued)

OTHER PUBLICATIONS

International Search Report issued by the European Patent Office in International Application PCT/DE2013/000383.
(Continued)

*Primary Examiner* — Kevin P Kerns
(74) *Attorney, Agent, or Firm* — Henry M. Feiereisen LLC.

(57) ABSTRACT

A continuously operating casting and rolling system with a strip tension control includes a casting unit having a melt-containing feed vessel with a horizontal casting channel and a discharge region in the form of a casting nozzle, and a primary cooling zone with two guide rolls and a circulating cooled casting strip and at least one downstream rolling unit having at least two drivable rollers. In order to minimize the tension on the cast strip, the casting unit and the subsequent rolling unit are mechanically decoupled, wherein for the decoupling at least one driver unit having at least two drivable rollers for driving the strip is arranged between the casting belt and the rolling unit.

9 Claims, 4 Drawing Sheets

(51) Int. Cl.
*B22D 11/041* (2006.01)
*B22D 11/06* (2006.01)
*B21B 1/46* (2006.01)

(58) Field of Classification Search
USPC ..... 164/417, 424
See application file for complete search history.

(56) References Cited

U.S. PATENT DOCUMENTS

| | | | | |
|---|---|---|---|---|
| 4,307,595 | A * | 12/1981 | Nishikubo et al. | B21B 1/16 700/152 |
| 4,708,193 | A * | 11/1987 | Tinnes | B22D 11/205 164/453 |
| 8,047,263 | B2 | 11/2011 | Spitzer et al. | |
| 8,069,904 | B2 | 12/2011 | Spitzer et al. | |
| 8,171,982 | B2 | 5/2012 | Franz et al. | |
| 8,302,663 | B2 | 11/2012 | Spitzer et al. | |
| 8,408,279 | B2 | 4/2013 | Spitzer et al. | |
| 8,852,356 | B2 | 10/2014 | Spitzer et al. | |
| 2009/0196785 | A1 | 8/2009 | Spitzer et al. | |
| 2009/0266503 | A1 | 10/2009 | Spitzer et al. | |
| 2010/0000703 | A1 | 1/2010 | Spitzer et al. | |
| 2010/0059196 | A1 | 3/2010 | Spitzer et al. | |
| 2010/0132911 | A1 * | 6/2010 | Bausch et al. | B22D 11/0631 164/463 |
| 2012/0093677 | A1 | 4/2012 | Spitzer et al. | |
| 2012/0121452 | A1 | 5/2012 | Spitzer et al. | |
| 2012/0132389 | A1 | 5/2012 | Spitzer et al. | |
| 2012/0138257 | A1 | 6/2012 | Spitzer et al. | |
| 2012/0279677 | A1 | 11/2012 | Kroos et al. | |

FOREIGN PATENT DOCUMENTS

| | | |
|---|---|---|
| DE | 10137246 | 2/2003 |
| DE | 102007056192 | 5/2009 |

OTHER PUBLICATIONS

Steel research 74: "Direct Strip Casting (DSC)—an Option for the Production of New Steel Grades"; Karl-Heinz Spitzer, Frank Rüppel, R. Viscorova, R. Scholz, J. Kroos, Volker Flaxa; 2003, pp. 724-731.

* cited by examiner

CONTINUOUSLY OPERATING STRIP CASTING AND ROLLING SYSTEM

CROSS-REFERENCES TO RELATED APPLICATIONS

This application is the U.S. National Stage of International Application No. PCT/DE2013/000383, filed Jul. 3, 2013, which designated the United States and has been published as International Publication No. WO 2014/005575 and which claims the priority of German Patent Application, Serial No. 10 2012 013 425.8, filed Jul. 3, 2012, pursuant to 35 U.S.C. 119(a)-(d).

BACKGROUND OF THE INVENTION

The invention relates to a continuously operating strip-casting and rolling system with strip tension control, including a casting unit with a melt-containing feed vessel with a horizontally disposed casting trough and a discharge area configured as a casting nozzle and two guide pulleys and a primary cooling zone having a revolving chilled casting strip, and at least one downstream rolling unit composed of at least two drivable rollers.

A continuous strip-casting and rolling system is known, for example, from steel research 74 (2003), No. 11/12, page 724-731. In particular, this production process which is known as DSC method (Direct Strip Casting) is suitable for the production of a hot strip from lightweight steel having a high manganese content.

In this known process, the melt is loaded from a feed vessel via a casting channel and a discharge area of a casting machine constructed as a casting nozzle in form of a siphon onto a revolving casting belt of a horizontal strip-casting system. As a result of intensive cooling of the casting strip, the supplied melt solidifies to form a pre-strip with a thickness ranging from 6-20 mm. After solidification throughout, the pre-strip is subjected to a hot rolling process.

Casting, rolling and coiling the steel strip requires from strip caster that the cast strand is removed from the casting machine with very little pulling force, ideally with zero pulling force. In particular, the known lightweight steels with a high manganese content have a tendency for strip breakage already at low strip pulling forces, especially when the strip is not yet fully solidified throughout, resulting in system downtime and increased repair costs.

In general, strip tension controls for continuously operating rolling mills are known, for example from DE 101 37 246 A1 or DE 26 18 901 C2. However, these devices designed for strip tension control in continuously operating rolling mills are not sufficient to control and maintain the strip tension between the casting unit and the downstream rolling unit at a sufficiently low level that band breakage can be reliably prevented.

SUMMARY OF THE INVENTION

It is therefore the object of the invention to provide a continuously operating strip casting and rolling system that can safely prevent strip breakage.

According to the teaching of the invention, the casting unit and the downstream rolling unit are mechanically decoupled in order to minimize strip tension, wherein for decoupling at least one driving unit having at least two drivable rollers for driving the strip is arranged between casting belt and rolling unit.

The strip casting and rolling system according to the invention is generally suitable for the production of hot strips from various metallic materials, in particular for lightweight steel with a high manganese content, which reacts very sensitively to excessive strip tensions.

Experiments have shown that the strip tension can be effectively controlled and kept very low only by the decoupling the casting unit of the following rolling unit according to the invention.

The operating times and thus the efficiency of the strip casting mill can be significantly increased by the decoupling according to the invention and the strip tension control, which then significantly reduces the maintenance costs for the strip casting system.

In another embodiment of the invention, the driver unit is additionally decoupled from the rolling unit. In this case, a pneumatically driven resilient unit operating as a looper is advantageously used for decoupling.

According to the invention, the drive unit is eccentrically mounted for rotation, wherein the rollers of the drive unit can be displaced substantially parallel to the strip normal during the casting and rolling process in the same direction as the casting direction or in the direction opposite to the casting direction.

The bearing locations can be located either below the lower roller or above the upper roller in the frame of the driver unit. The bearing system corresponds here to a pendulum bearing of the driver unit, wherein the "pendulum" (drive unit) is supported either at the bottom or at the top.

Either a single driver unit or multiple driver units, which are each supported eccentrically for rotation, may be provided depending on the design of strip casting and rolling system.

Due to the inventive bearing, the individual drive units with the pairs of rollers can perform movements in the same direction as the casting direction and in the opposite direction. According to the invention, the drive units are supported via load cells (tension-compression) against the frame of the multi-roller smoothing system. The movements resulting from the applied force in the same direction as the casting direction and in the direction opposite thereto are limited by the elasticity of the load cells in the measuring range (Hughscher range) to a few μm. As a result, no effective movements are performed in the direction of the strip normal.

In another advantageous embodiment, especially the upper rollers of the drive units are provided with copper sheaths to accelerate cooling at the top of the solidifying strip.

BRIEF DESCRIPTION OF THE DRAWING

Other features, advantages and details of the invention will become apparent from the following description of exemplary embodiments shown in a drawing, which shows in.

Figure 1:
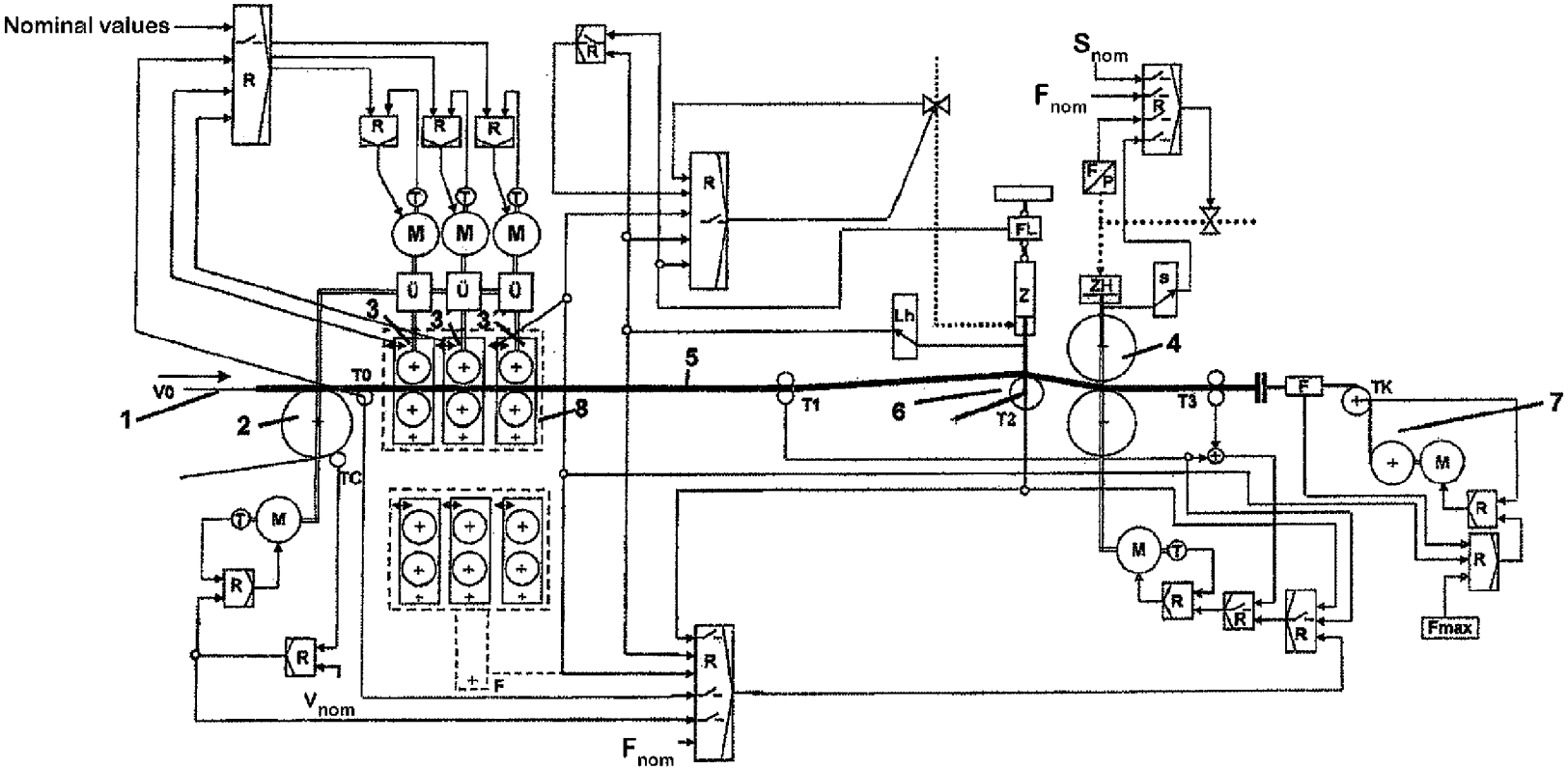
FIG. 1 a schematic partially illustrated embodiment of a strip casting and rolling system according to the invention and of a strip tension control, FIG. 2 a first alternative embodiment, FIG. 3 a second alternative embodiment, FIG. 4 a third alternative embodiment.

Details of the invention are apparent from the following description of an exemplary embodiment schematically shown in the drawing. Shown in FIG. 1 is a partial detail of a strip casting and rolling system according to the invention with a strip tension control that minimizes strip tension.

This partial diagram illustrates in particular the facility area "Transfer of the cast strip from the conveyor belt to the downstream equipment".

The strip casting and rolling system is composed of an unillustrated casting unit with a feed vessel containing the melt, with a horizontally positioned casting trough and an outlet area constructed as a casting nozzle and a primary cooling zone having two guide rollers and a circulating cooled conveyor belt 1 and at least one downstream rolling unit 4 composed of at least two drivable rollers. Illustrated here is the guide pulley 2 of the conveyor belt 1 at the transfer side to the rolling unit 4.

According to the invention, the casting unit (caster) and the subsequent rolling unit 4 are mechanically decoupled, wherein for the purpose of the decoupling, three driver units 3, 3', 3" each having two rollers for driving the cast strip 5 are arranged between the conveyor belt 1 and the rolling unit 4.

In addition, the driver unit 3, 3', 3" is decoupled from the rolling unit 4, wherein a pneumatically driven lifting device 6, a resilient unit operating as a looper, is used for decoupling.

The strip tension is minimized with the illustrated controller R during the continuous strip casting and rolling process as follows:

The cast strip is first moved along by the conveyor belt 1 with the master velocity v0. The discharge speed of the strip 5 is measured by a tachometer T0, T1, T2, T3, TK, or TC and the peripheral speed of the drive rolls is synchronized to T0. The strip 5 enters with this speed the driver units 3, 3', 3" of a multi-roller smoothing system.

After entering the pair of rollers of the first drive unit 3, the upper roller is lowered onto the strip 5 with a defined force. Due to an existing lack of synchronicity between the conveyor belt 1 and the pair of rollers, the strip 5 is pulled by the conveyor belt 1 or decelerated. A first controller now intervenes and adjusts the speed of the pair of rollers so that the pair of rollers does not exert tensile or compression forces on the cast strip 5.

Lack of synchronicity can be caused, for example, by different roller diameters (wear), by different contact forces (degree of deformation) or shrinkage due to cooling of the strip.

Thereafter, the pair of rollers of the second driver unit 3' is lowered onto the strip 5. In this case, too, a small lack of synchronicity in the speed exists. This lack of synchronicity of the second pair of rollers produces a tensile or compressive force on the first drive unit 3 of the first pair of rollers. This force is measured and evaluated with a force-measuring device F. The driver units 3, 3', 3" are for this purpose arranged in a frame 8, wherein the respective force measuring devices of the driver units 3, 3', 3" are supported against this frame 8.

The speed of the second pair of rollers of the driver unit 3' is now adjusted with another controller so as to produce a tensile force of ideally 0 N. The pairs of rollers of the third drive unit 3" and possibly all other pairs of rollers operate analogous to the second pair of rollers.

The solidifying strip 5 now exits the driver units 3, 3', 3" of the multi-roller smoothing system and is pulled by a pilot tension-startup device 7. The last pair of rollers has likewise a force measuring device disposed on the driver unit 3". The pilot tension-startup device 7 is also adjusted to a measured tensile force of 0 N to the last pair of rollers, and pulls the strip 5 via the lifting device 6 into the not yet switched-on rolling unit 4. Only a single rolling stand is shown as the rolling unit 4; however, several rolling stands may be employed depending on the requirement.

When the strip 5 has entered the still open rolling gap S, the looper arc is set up (the looper is lifted) and the rolling gap S is closed. The looper height Lh and the rolling speed now exert a lower force FL on the last pair of rollers of the driver unit 3"" of the multi-roller smoothing system. The effect of the lifting device 6 and the rolling unit 4 on the force measurement at the driver unit 3"" of the last pair of rollers of multi-roller smoothing system is adjusted via yet another controller so as to produce here also tensile force of 0 N.

When the rolling unit 4 has gripped the strip 5 with sufficient traction, the pilot tension-startup device 7 is detached from the strip.

In contrast to the conventional loopers, the loopers for the lifting device 6 are advantageously pneumatic cylinders Z or hydraulic cylinders ZH with very low inlet pressure. Such system produces a very soft, self-cushioning unit. The soft, self-cushioning property of the looper supports the minimal pulling force applied to the strip and the solidifying strip required for the production of lightweight steels with high-manganese content.

In an advantageous embodiment, the rollers of the rolling unit 4 are placed on the strip by way of active hydraulic shock absorbers 9 so as to reduce or suppress effects resulting from the immersion of the rollers in the strip 5 (degree of deformation).

The resulting looper arc gives the rolling speed control sufficient time to correct any resulting lack of synchronicity.

The pilot tension-startup device 7 already pulls the cast strip 5 with the required force in the first rolling stand of the rolling unit 4, thereby eliminating force jumps also in this situation.

The touch-down speed of the rollers is synchronized by way of inlet tachometers T0, T1, T2, T3, TK, or TC before touchdown to the speed of the incoming strip 5. This also prevents interference with the strip 5.

The looper control can either be force-controlled, height-controlled or designed as a physical looper model.

The employed drives can be, for example, asynchronous motors. However, DC motors may also be used. When employing asynchronous motors, these are supplied via frequency converters, wherein each drive has an internal PID controller.

The required tensile force may be set separately as a nominal value for the pilot tension-startup device 7 and the pulling force for the rolling unit 4.

The multi-roller smoothing system with the drive units 3, 3', 3" is according to the invention rigidly connected to the drive of the casting belt 1 by way of superposition gears (Ü). Very brief variations in the speed of the cast strip 5 are then also transferred to the multi-roller smoothing system, thereby eliminating even very brief speed differences between the strip 5 and the band multi-roller smoothing system with the drive units 3, 3', 3".

Figure 2:
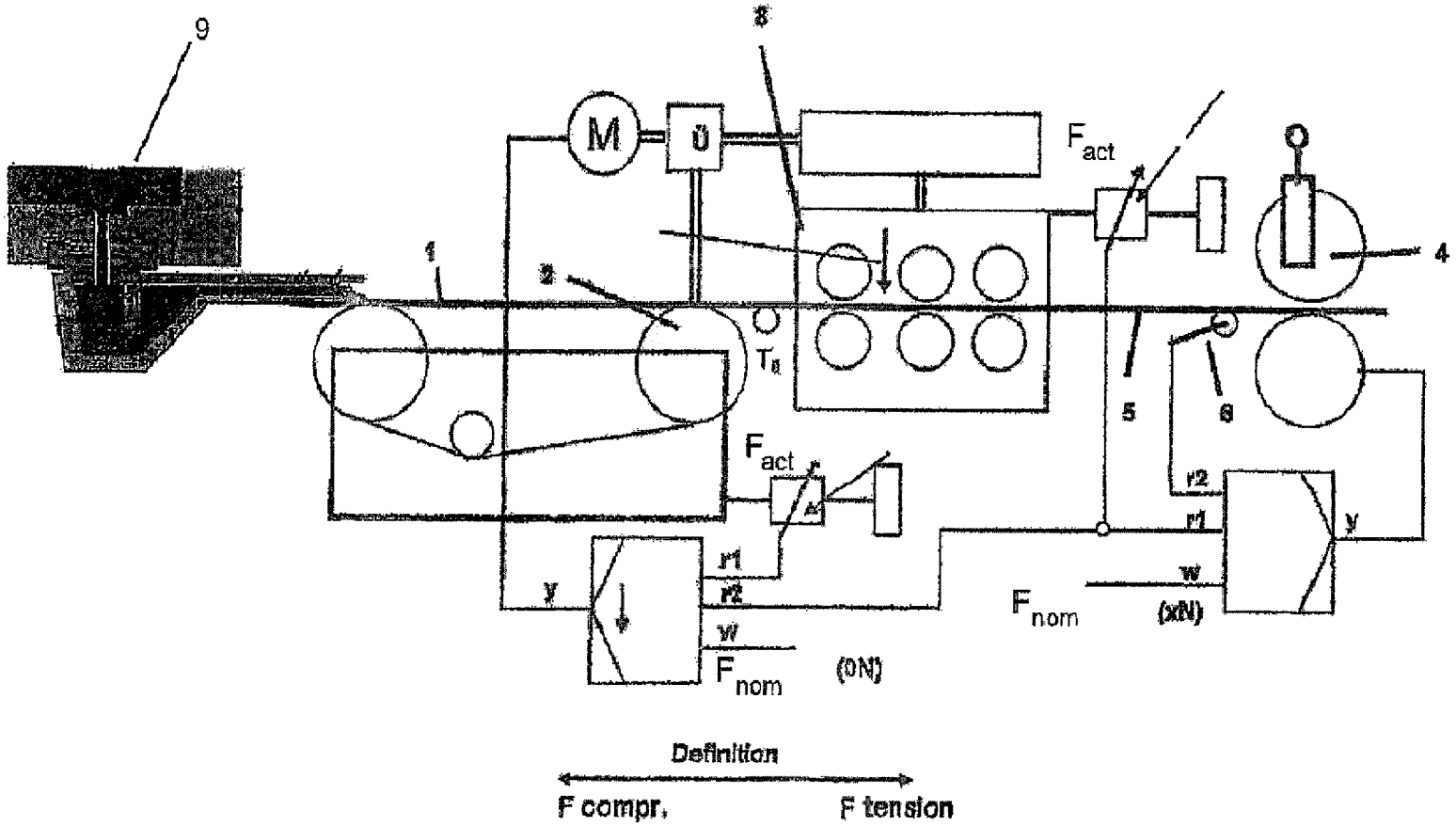

FIG. 2 shows an alternative control concept. Identical reference symbols represent identical components.

In this case, the strip tension is measured by way of an additional load cell, which is mounted on the frame of the casting unit (caster) 9. The force measurement directly indicates the reaction forces to the tension forces or compression forces applied to the strip. This measured value is supplied to a controller which directly controls the rotation speed of a superposition motor (M).

With this type of control, the measured forces on the frame 8 of the driver unit and on the frame of the casting unit (Caster) are advantageously accounted for and the difference between the two measurements is regulated to 0 N.

Figure 3:
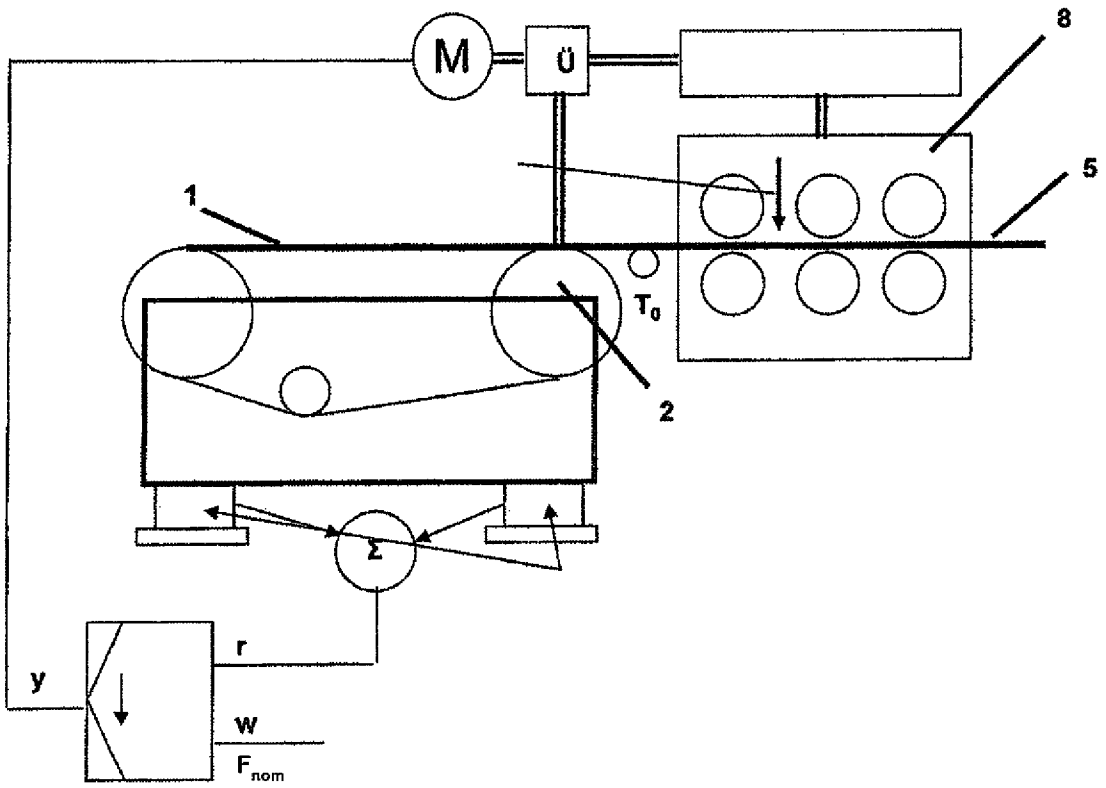
Figure 4:
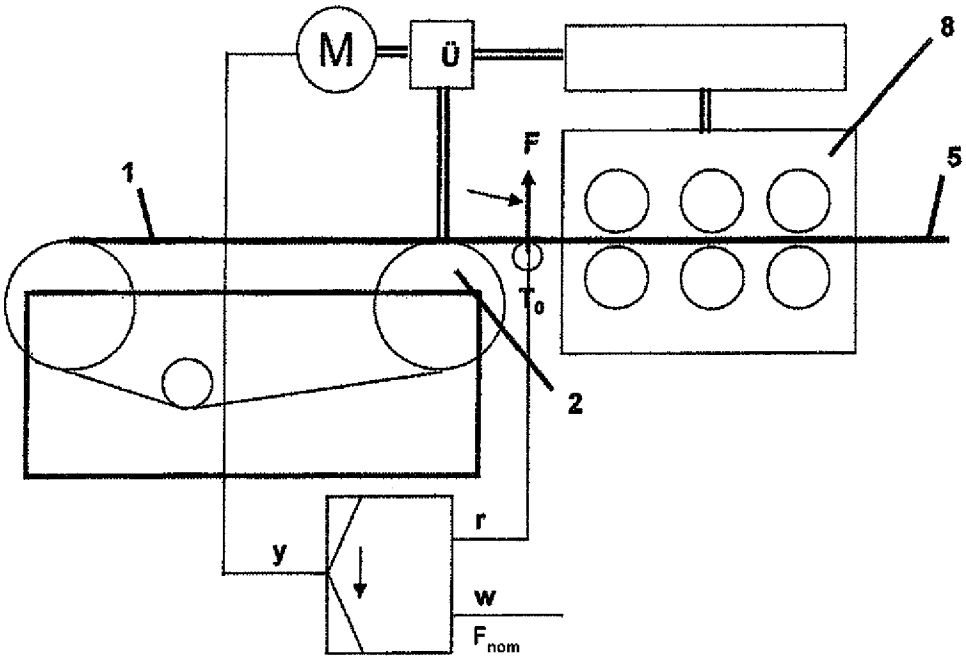

FIG. 3 shows another alternative. The reaction force of the caster frame is here measured with load cells either individually or as a total force. The caster frame either rests on these particular force measuring systems or is suspended therefrom. The reaction force of the caster frame is here also regulated to 0 N by using the superposition drive.

The invention claimed is:

1. A continuously operating strip-casting and rolling system with strip tension control for a strip, comprising:

a casting unit having a melt-containing feed vessel with a horizontally disposed casting trough and a discharge area having a tachometer connected therewith used to measure the discharge speed of the strip, or used as a mini-looper, the discharge area configured as a casting nozzle and a primary cooling zone comprising two guide pulleys and a revolving cooled casting belt, and at least one downstream rolling unit comprising at least two drivable rollers, at least one driver unit comprising at least two further drivable rollers arranged between the casting belt and the at least one downstream rolling unit for driving the strip, wherein the at least one driver unit mechanically decouples the casting unit and the at least one downstream rolling unit so as to minimize tension applied to the strip, and a lifting device interconnected between the at least one driver unit and the at least one downstream rolling unit, said lifting device lifting the strip for decoupling the at least one driver unit and the at least one downstream rolling unit wherein the at least one driver unit is eccentrically mounted for rotation, wherein the at least two further drivable rollers are during a casting and rolling process displaceable substantially parallel to a longitudinal axis of the strip in a direction identical to a casting direction or in opposition to the casting direction.

2. The device of claim 1, wherein the at least one driver unit is arranged in a frame and the individual driver units are supported against the frame by way of force measuring devices.

3. The device according to claim 1, wherein drives that drive the casting belt and drives that drive the at least one driver unit are mechanically coupled.

4. The device of claim 3, wherein the drives that drive the casting belt and the drives that drive the at least one driver unit are mechanically coupled by way of a superposition gear.

5. The device of claim 3, wherein the drives that drive the casting belt and the drives that drive the at least one driver unit comprise direct current motors.

6. The device according to claim 1, wherein the lifting device is constructed as a self-cushioning unit.

7. The device according to claim 6, wherein the self-cushioning unit is a pneumatic cylinder.

8. The device of claim 1, wherein the at least two drivable rollers of the rolling unit comprise shock absorbers configured to cushion a touchdown on the strip.

9. The device of claim 8, wherein the shock absorbers are adjustable hydraulic shock absorbers configured to be switched off.

* * * * *